US008083199B2

(12) United States Patent
Brewer

(10) Patent No.: US 8,083,199 B2
(45) Date of Patent: Dec. 27, 2011

(54) POOL NET MOUNTING DEVICE

(76) Inventor: Charles E. Brewer, Cherryville, NC (US)

( * ) Notice: Subject to any disclaimer, the term of this patent is extended or adjusted under 35 U.S.C. 154(b) by 90 days.

(21) Appl. No.: 12/460,460

(22) Filed: Jul. 20, 2009

(65) Prior Publication Data

US 2011/0012007 A1 Jan. 20, 2011

(51) Int. Cl.
*A47G 1/10* (2006.01)

(52) U.S. Cl. ..... 248/316.7; 4/496; 210/167.19; 248/210; 248/229.1; 248/229.16

(58) Field of Classification Search ..... 248/514, 248/313, 316.7, 61, 113, 77, 210, 229.1, 248/229.11, 229.16, 230.6, 230.1; 210/776, 210/167.9, 232; 4/496, 494
See application file for complete search history.

(56) References Cited

U.S. PATENT DOCUMENTS

| | | | | | |
|---|---|---|---|---|---|
| 1,858,656 | A | * | 5/1932 | Batherman | 248/210 |
| 2,912,196 | A | * | 11/1959 | Johnson | 248/538 |
| 3,162,409 | A | * | 12/1964 | Straayer et al. | 248/514 |
| 3,625,364 | A | | 12/1971 | Chance | |
| 4,332,683 | A | | 6/1982 | Alt | |
| 4,369,109 | A | | 1/1983 | Edge | |
| 4,734,189 | A | | 3/1988 | Page, Jr. | |
| 4,781,827 | A | | 11/1988 | Shields | |
| 4,827,654 | A | * | 5/1989 | Roberts | 43/21.2 |
| 5,173,181 | A | | 12/1992 | McFarland | |
| 5,288,414 | A | | 2/1994 | Mongiello | |
| 5,454,940 | A | | 10/1995 | Lakotish | |
| 5,487,830 | A | | 1/1996 | Huppert | |
| 5,588,630 | A | * | 12/1996 | Chen-Chao | 248/514 |
| 5,765,699 | A | | 6/1998 | Griffin | |
| 5,849,184 | A | | 12/1998 | Veillet | |
| 6,123,305 | A | * | 9/2000 | Lukasavitz | 248/292.12 |
| 6,989,093 | B1 | | 1/2006 | Greathead | |
| 2002/0027097 | A1 | | 3/2002 | Baer | |
| 2003/0160140 | A1 | * | 8/2003 | Nastase | 248/210 |
| 2005/0011819 | A1 | | 1/2005 | Gillen | |
| 2006/0102822 | A1 | * | 5/2006 | Liang | 248/514 |
| 2007/0215770 | A1 | * | 9/2007 | Bonjour et al. | 248/229.1 |

* cited by examiner

*Primary Examiner* — Ramon Ramirez
(74) *Attorney, Agent, or Firm* — Kyle S. Brant

(57) ABSTRACT

A pool net mounting device is disclosed. The mounting device includes a pool net holding portion having a hollow cylindrical tube adapted to receive and secure a pool net in a plurality of angular orientations. The pool net mounting device also includes a mounting portion adapted to be removably attached to a cylindrical object such as a pool ladder rail. The net holding portion and the mounting portion are removably attached to each other in a variety of angular positions so that a wide range of configurations is achieved for orienting a pool debris net at a desired angular orientation and height. The net holding portion includes a number of apertures and slots therein for receiving a spring loaded pin, a common feature of pool nets. Alternative pool net attachment features are also disclosed.

17 Claims, 4 Drawing Sheets

POOL NET MOUNTING DEVICE

FIELD OF THE INVENTION

This invention relates in general to pool cleaning devices and more particularly to a device that enables convenient attachment of a pool debris skimming net to a cylindrically shaped object.

BACKGROUND OF THE INVENTION

The present invention relates to a device for skimming debris off the surface of a body of water and, more particularly, for skimming debris such as dead leaves, twigs, insects and scum off of the surfaces of pools prior to their sinking and forming a sludge at the bottom of the pool.

Skimming debris from the water surface of pools is done either manually, by hand, using a net attached to a long handle and manipulated by a person, or by positioning a debris skimming net in a location where water currents flowing around the pool urge the floating debris to move along fairly well defined paths created by the moving currents. A generally circular flow of water from pump inlet to outlet creates the current flows in the pool.

A variety of devices are known in the prior art for mounting a pool debris skimming net over a swimming pool. In many instances, the net mounting devices are bulky, lacking in flexibility to orient the net at a desired attitude or angle, difficult to install and some are quite expensive to produce. Ideally, a pool net mounting device is adaptable for use with all pool installations be they in-ground or above-ground pools. In addition the ideal device should include net positioning features that enable a multitude of net positioning options, is small and lightweight, is easily removed for storage purposes, and is inexpensive to produce. What is needed is a pool net mounting device that incorporates all of these desirable features.

SUMMARY OF THE INVENTION

A device for removably mounting a pool net having a tubular shaft, according to one aspect of the present invention, comprises mounting means adapted to be removably attached to a cylindrical mounting surface, net holding means for securely receiving the tubular shaft of the pool net and maintaining the shaft at a desired angular orientation, and attachment means for attaching the mounting means to the net holding means in one of a plurality of predetermined angles, the attachment means having a portion thereof disposed on the mounting means and a portion thereof disposed on the net holding means.

One object of the present invention is to provide an improved pool net mounting device.

Another object of the present invention is to provide a pool net mounting device that is less expensive yet provides enhanced configurations over the prior art.

Still another object of the present invention is to provide a pool net mounting device that is easily installed and removed from a cylindrical object such as a pool ladder.

Yet another object of the present invention is to provide a pool net mounting device that may be removably attached to a cylindrical object and provides multiple angular and height positioning features for attaching a debris net shaft thereto.

These and other objects of the present invention will become more apparent from the following figures and description of the preferred embodiments.

DESCRIPTION OF THE PREFERRED EMBODIMENTS

Figure 1:
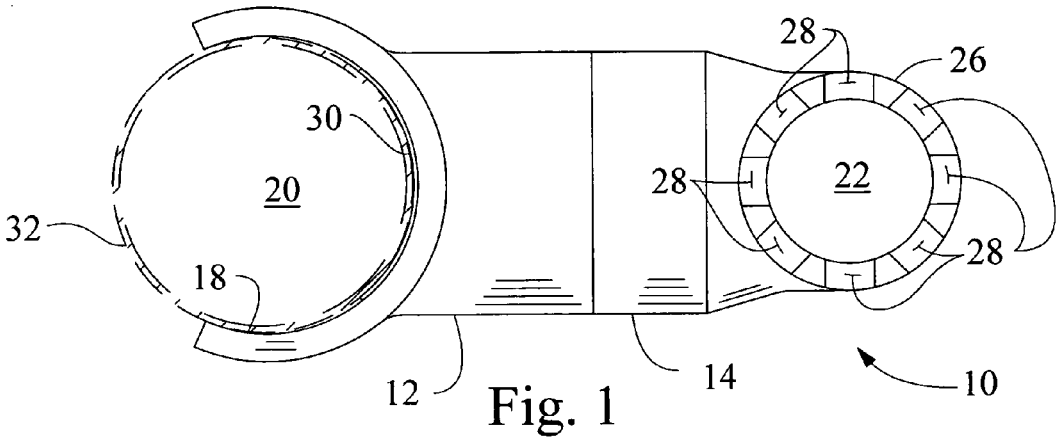
FIG. 1 is a plan view of a pool net mounting device according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
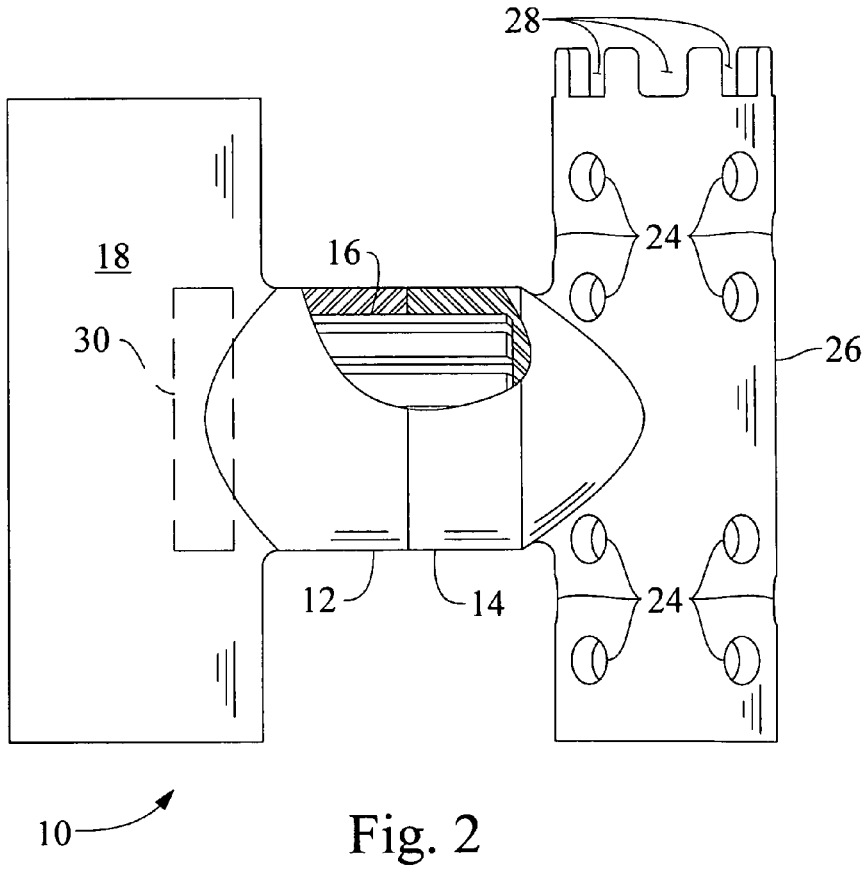
FIG. 2 is a partial cut-away front elevational view of the pool net mounting device of FIG. 1.
Figure 3:
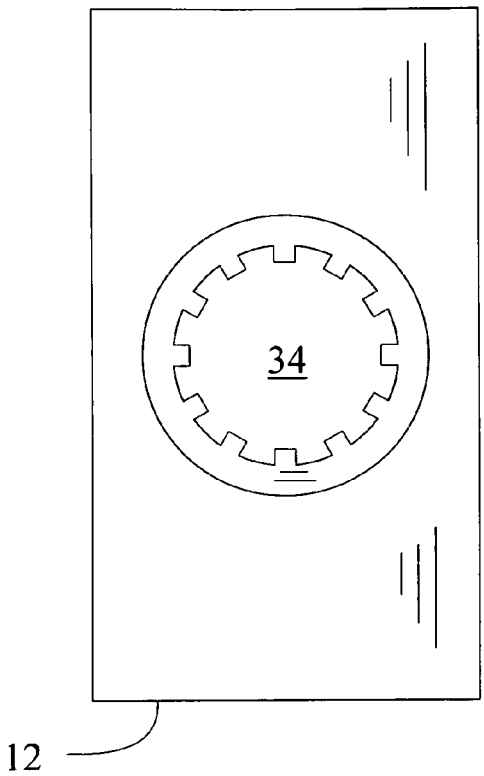
FIG. 3 is a side elevational view of the ladder clip shown in FIG. 1.
Figure 5:
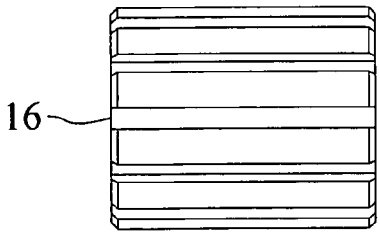
FIG. 5 is a front elevational view of the spline connector.
Figure 6:
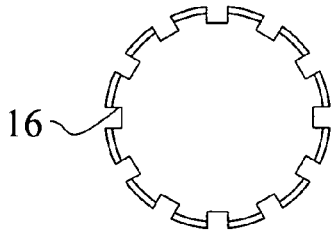
FIG. 6 is an end elevational view of the spline connector

Referring now to FIGS. 1 and 2, a plan view (FIG. 1) and a front elevational view (FIG. 2) of a pool net mounting device 10 according to the present invention is shown. Pool net mounting device 10 includes ladder clip 12, net mount adapter 14, and spline connector 16 (see FIGS. 5 and 6) used to internally attach or join clip 12 to adapter 14. Cylindrical portion 18 defines a partial cylindrical aperture 20 that is sized to receive and securely snap onto a cylindrical object such as the metal tubing used in the fabrication of a pool ladder. Adapter 14 includes a cylindrical aperture 22 therethrough sized to receive the shaft of a debris skimming net (see FIG. 7). A number of circular apertures 24 extend through the cylindrical portion 26 of adapter 14. Apertures 24 are in fluid communication with aperture 22 and are sized to receive a spring-pin (shown in FIG. 7) of a debris net. Slots 28 are also size to receive a spring-pin of a debris net. Anti-slip material 30, typically made of a rubber-like compound, is adhesively attached to cylindrical portion 18 to provide an anti-rotational gripping force between cylindrical portion 18 and pool ladder tubing (shown in FIG. 7).

Figure 4:
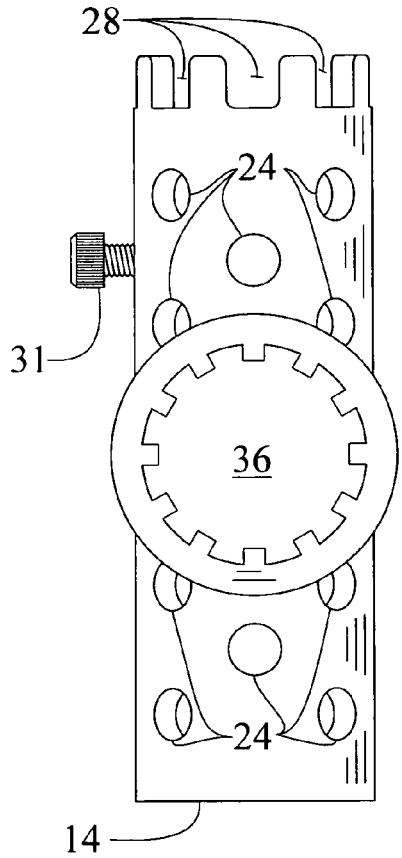
FIG. 4 is a side elevational view of the net mount adapter shown in FIG. 1.

Referring now to FIGS. 3-6, a side elevational view of clip 12 (FIG. 3), a side elevational view of adapter 14 (FIG. 4) and a front (FIG. 5) and side elevational view (FIG. 6) of spline connector 16 are shown. Spline connector 16 includes a plurality of splines that serve to define a multitude of angular positions for connecting clip 12 to adapter 14. Spline 16 is inserted into mating spline apertures 34 and 36 to assemble or connect clip 12 to adapter 14. Spline connector 16 is sized so that insertion of connector 16 is achieved with a moderate insertion force into apertures 34 and 36 attributable to a fairly small interference fit. It is contemplated that connector 16 may be formed or molded as a part of either clip 12 or adapter 14 rather than as a separate component part of device 10. Also shown in FIG. 4 is set screw 31 installed in a threaded aperture in adapter 14. Set screw 31 is useful when the debris net does not include a locating pin or spring-pin feature. The threaded aperture into which screw 31 is inserted may require additional reinforcement such as a threaded metal insert (not shown) to increase the mounting thread strength and thereby enable larger forces created when rotating set screw 31 into the threaded aperture of adapter 14. Set screw 31 may be replaced by a nut and bolt, wherein the nut and bolt assembly extends through opposing apertures 24 and the shaft of the net when the net is disposed in aperture 22.

Figure 8:
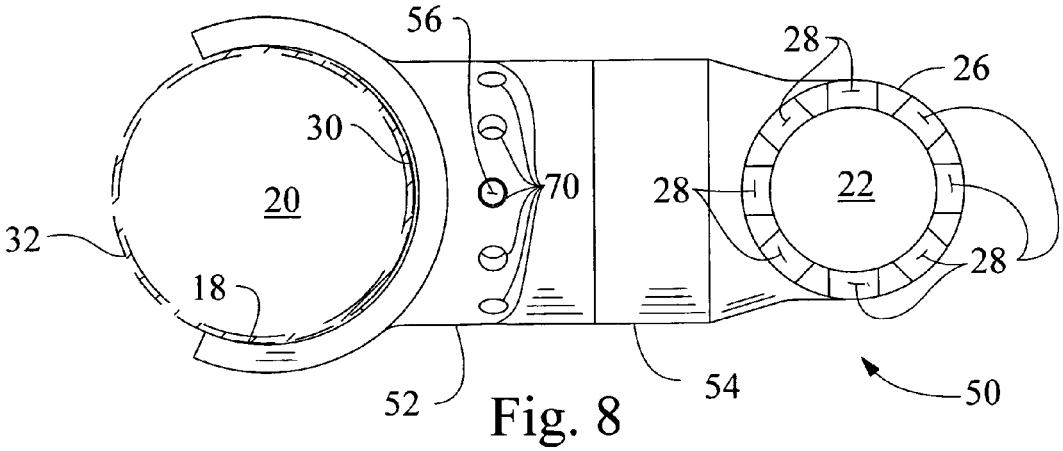
FIG. 8 is a plan view of a pool net mounting device according to another aspect of the present invention.
Figure 9:
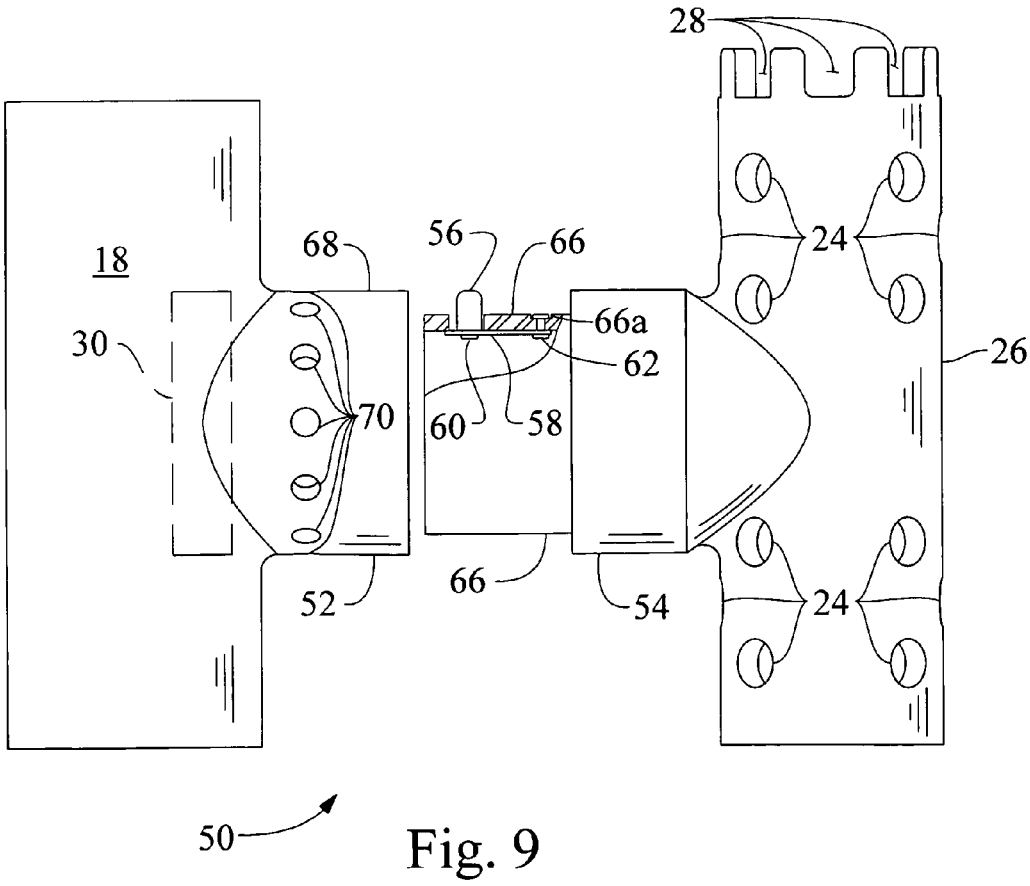
FIG. 9 is a cut-away exploded front elevational view of the pool net mounting device of FIG. 8.

It is also contemplated that a number of design approaches may be taken for attachment of clip 12 to adapter 14 to achieve a device that provides a multitude of angular configurations of various relationship between clip 12 and adapter 14. Spline connector 16 may be integrally formed or molded as a part of either clip 12 or adapter 14 thereby eliminating a molded part. Alternatively, the spline engagement design of device 10 could be replaced by a concentric cylindrical sleeve design with an engaging spring-loaded locking pin quite similar to the manner that a debris net shaft extension slides over and clips onto a pool debris net. Such an embodiment is shown in FIGS. 8 and 9. Further, a simple concentric cylindrical interface with a small molded protrusion (such as a plastic dimple) on one concentric cylinder and small indentations sized to receive and engage the dimple in the other concentric cylinder would enable multiple assembly positions for clip 12 versus adapter 14. In practice, a large number of multi-angular assembly approaches could be taken for the clip 12 to adapter 14 connection, the important aspect being to provide flexibility in the angular assembly relationship between clip 12 and adapter 14. It is also contemplated that clip 12 and adapter 14 may be machined or molded as a single piece unit without any angular adjustment therebetween. Velcro, wire-ties, hose clamps, nylon tie-wrap straps, and rubber o-ring grommets (a rubberized gripping device) may also be used to more securely attach clip 12 to a cylindrical object such as a pool ladder.

Figure 7:
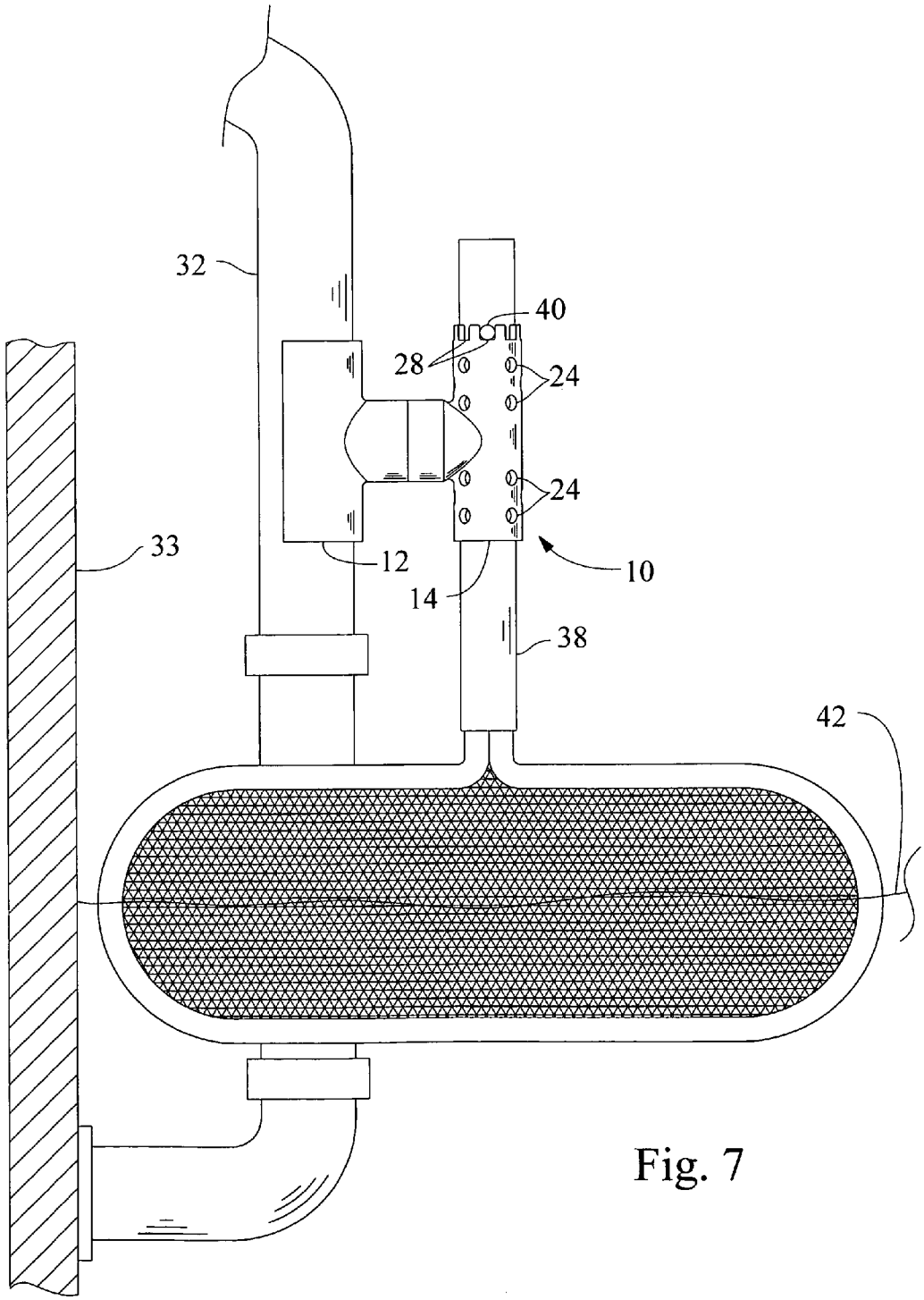
FIG. 7 is an illustration depicting the pool net mounting device of FIG. 1 attached to a pool ladder and including a debris skimming net attached thereon.

Referring now to FIG. 7, and operationally speaking, device 10 is shown attached to a cylindrical object such as pool ladder 32 (also shown in cross-section in FIG. 1). Device 10 conveniently and easily snaps onto ladder 32 by positioning the c-shaped cross-sectional aperture 20 of ladder clip 12 against ladder 32 and applying a horizontal force thereto. It should be readily recognized that ladder clip 12 is easily removed at a later time by applying a horizontal force to separate ladder clip 12 from ladder 32. Anti-slip material 30 provides a frictional gripping force between clip 12 and ladder 32 preventing undesirable rotation of clip 12 versus ladder 32. Ladder 32 is attached to the pool wall 33 (shown in cross-section). Clip 12 may be rotated to any desired angular position versus ladder 32 to position debris net 38 in a desired location such as a current flow path in the pool water 42. The angular orientation of clip 12 versus adapter 14 is selected by the user during assembly of the clip 12 and adapter 14 using spline connector 16. The handle of debris net 38 is inserted into aperture 22, and the angular orientation of debris net 38 is established by rotating the net so that a spring-pin 40 extending radially outward from within the pool net shaft engages one of the circular apertures 24 or one of the slots 28. As shown, spring-pin 40 is located in one of the slots 28, however it should be readily recognized that spring-pin 40 may also be situated in any of the apertures 24 to angularly position the net at a desired angle and depth in the pool water 42.

The standard outer diameter of debris net poles is known to be 1.125 inches, thus aperture 22 is typically dimensioned to 1.15 inches. It is contemplated that other net shaft diameters may be accommodated with corresponding dimensional changes to adapter 14 and the diameter at aperture 22 wherein a small clearance spacing is provided to allow the net shaft to slide easily in and out of aperture 22. Debris nets 38 typically include internal spring-pins 40 to engage mating holes in tubular extension shafts.

Ladder clip 12 and net mount adapter 14 are preferably manufactured from thermoplastic materials such as PVC (polyvinyl chloride) or any other suitable material having some resiliency and rust resistance. Alternative materials include polyethylene and polypropylene. Anti-slip material 30 is made of rubber or man-made equivalent.

Referring now to FIGS. 8 and 9, another embodiment of a pool net mounting device 50 according to the present invention is shown. FIG. 8 is a plan view of device 50 and FIG. 9 is an exploded cut-away front elevational view thereof. Features of device 50 that are identical to those shown in device 10 are numbered with like numerals in FIGS. 8 and 9. Mount device 50 replaces the spline connector with a spring-pin and concentric cylindrical mating member. Mounting device 50 is comprised of a ladder clip 52 and a net mount adapter 54. Clip 52 and adapter 54 are shown in exploded fashion in FIG. 9 so that the details of spring-pin 56 and spring 58 are readily seen. Spring-pin 56 is attached to spring 58 via a rivet 60. Rivet 62 attaches spring 58 to the internal surface of cylindrical portion 66 of adapter 54. Assembly of device 50 requires insertion of hollow cylindrical member 66 of adapter 54 into hollow cylindrical member 68 of clip 52. Spring 58 enables pin 56 to be displaced radially inward on cylindrical member 66 so that cylindrical member 66 is insertable within cylindrical member 68. Upon insertion of cylindrical mating member 66 into cylindrical mating member 68, adapter 54 is rotated to a desired angular relationship versus clip 52 and spring-pin 56 engages one of apertures 70 sized to receive spring-pin 56. Apertures 70 are equi-angularly spaced about the cylindrical surface of cylindrical member 68 for a total of twelve apertures, yet more or less apertures 70 are contemplated. Spring 58 is a rectangular flat metal spring that urges pin 56 into the position shown in FIG. 9. A circular recess is formed in cylindrical member 66 at **66*a* so that rivet 62 does not interfere with mating of cylindrical mating members 66 and 68. Also shown in FIGS. 8 and 9 are apertures 20 and 22, cylindrical portion 18, cylindrical portion 26, apertures 24, slots 28, and anti-slip material 30, each having identical properties and characteristics as the identically numbered items in FIGS. 1-7. Device 50 functions identically to device 10 with the sole differences residing in the manner in which the two primary components, clip 52 and adapter 54, are attached to one another. Materials used in the construction of device 50 are identical to those used in the fabrication of device 10**.

The embodiments shown utilize two different approaches for attaching clip 12 to adapter 14, yet it should be readily apparent that screws, nuts and bolts or pop rivets are equally suitable to attach these two components to one another. The embodiments shown are more convenient in that no tools are required for assembly of the two primary components of the invention.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A device for removably mounting a pool net having a tubular shaft and a locating pin extending radially outward from the tubular shaft, said device comprising:

mounting means adapted to be removably attached to a cylindrical mounting surface, said mounting means having a c-shaped cross section;

net holding means for securely receiving the tubular shaft of the pool net and maintaining the shaft at a desired angular orientation by engaging the locating pin of the tubular shaft; and attachment means for attaching said mounting means to said net holding means in one of a plurality of predetermined angles, said attachment means having a portion thereof disposed on said mounting means and a portion thereof disposed on said net holding means.

2. The device of claim 1 wherein said mounting means includes first and second resilient opposing gripping members situated in a spaced apart relationship so that the cylindrical mounting surface is removably received therebetween.

3. The device of claim 2 wherein said first and second resilient opposing gripping members are formed from a resilient cylindrical tube with a portion thereof removed along a plane parallel to and spaced apart from the radial center of said tube so that said cylindrical tube has a c-shaped cross section.

4. The device of claim 3 wherein said net holding means is comprised of:

a hollow member having a net shaft aperture therethrough; and securing means for securing said net within said hollow member at a desired angular position.

5. The device of claim 4 wherein said securing means includes:

a threaded aperture in said hollow member that extends into said net shaft aperture; and a threaded member sized to mate with said threaded aperture and rotatably inserted into said threaded aperture.

6. A device for removably mounting a pool net having a tubular shaft including a spring-pin, said device comprising:

mounting means adapted to be removably attached to a cylindrical mounting surface, said mounting means including first and second resilient opposing gripping members situated in a spaced apart relationship so that the cylindrical mounting surface is removably received therebetween, wherein said first and second resilient opposing gripping members are formed from a resilient cylindrical tube with a portion thereof removed along a plane parallel to and spaced apart from the radial center of said tube so that said cylindrical tube has a c-shaped cross section;

net holding means for securely receiving the tubular shaft of the pool net and maintaining the shaft at a desired angular orientation, said net holding means comprised of a hollow member having a net shaft aperture therethrough and securing means for securing said net within said hollow member at a desired angular position, said securing means having a plurality of through holes in said hollow member wherein said plurality of through holes are in fluid communication with said net shaft aperture; and attachment means for attaching said mounting means to said net holding means in one of a plurality of predetermined angles, said attachment means having a portion thereof disposed on said mounting means and a portion thereof disposed on said net holding means.

7. A device for removably mounting a pool net having a tubular shaft and a locating pin, said device comprising:

mounting means adapted to be removably attached to a cylindrical mounting surface and wherein said mounting means includes first and second resilient opposing gripping members situated in a spaced apart relationship so that the cylindrical mounting surface is removably received therebetween and wherein said first and second resilient opposing gripping members are formed from a resilient cylindrical tube with a portion thereof removed along a plane parallel to and spaced apart from the radial center of said tube so that said cylindrical tube has a c-shaped cross section;

net holding means for securely receiving the tubular shaft of the pool net and maintaining the shaft at a desired angular orientation, said net holding means comprising a hollow member having a net shaft aperture therethrough and securing means for securing said net within said hollow member at a desired angular position said securing means comprising a plurality of voids in said hollow member situated about the periphery of said net shaft aperture, said voids sized to receive the pool net locating pin; and attachment means for attaching said mounting means to said net holding means in one of a plurality of predetermined angles, said attachment means having a portion thereof disposed on said mounting means and a portion thereof disposed on said net holding means.

8. A device for removably mounting a pool net having a tubular shaft, said device comprising:

mounting means adapted to be removably attached to a cylindrical mounting surface, said mounting means including first and second resilient opposing gripping members situated in a spaced apart relationship so that the cylindrical mounting surface is removably received therebetween and wherein said first and second resilient opposing gripping members are formed from a resilient cylindrical tube with a portion thereof removed along a plane parallel to and spaced apart from the radial center of said tube so that said cylindrical tube has a c-shaped cross section;

net holding means for securely receiving the tubular shaft of the pool net and maintaining the shaft at a desired angular orientation, said net holding means comprising a hollow member having a net shaft aperture therethrough and securing means for securing said net within said hollow member at a desired angular position; and attachment means for attaching said mounting means to said net holding means in one of a plurality of predetermined angles, said attachment means having a portion thereof disposed on said mounting means and a portion thereof disposed on said net holding means, said attachment means comprised of a protruding member extending outward from the surface of said hollow member and a mount receiving member attached to said resilient cylindrical tube and adapted to removably receive said protruding member.

9. A device for removably mounting a pool net having a shaft, said device comprising:

a resilient cylindrical tube with a portion thereof removed along a plane parallel to and spaced apart from the radial center of said tube so that said resilient cylindrical tube has a c-shaped cross section;

a net holding member attached to said resilient cylindrical tube, said net holding member having a net aperture therethrough and wherein said net aperture is sized to correspond in geometry with and receive the shaft of the pool net; and angular mounting means situated on said net holding member for removably securing the net in a desired angular position within said net aperture.

10. The device of claim 9 wherein the net includes a spring-pin extending radially outward from the shaft, and wherein:

said net holding member has a hollow cylindrical shape; and said angular mounting means is a plurality of through holes extending through said net holding member in fluid communication with said net aperture.

11. The device of claim 10 wherein said net holding member includes a plurality of slots situated about the periphery of the net holding aperture and sized to receive the spring-pin of the pool net.

12. The device of claim 9 wherein said resilient cylindrical tube and said net holding member are rotatably attached to each other and positionable with respect to one another in a plurality of angular positions.

13. A device for securely mounting a swimming pool accessory device having a shaft and a locating pin extending radially outward from the shaft, said device comprising:

a resilient c-shaped tube having a portion thereof removed along a plane parallel to and spaced apart from the radial center of said tube so that said resilient cylindrical tube has a c-shaped cross section;

a shaft holding member attached to said c-shaped tube, said shaft holding member having a shaft aperture therethrough and wherein said shaft aperture is cylindrical and sized to correspond in geometry with and receive the shaft of the pool accessory device; and means for securing the shaft of the pool accessory device in said net aperture at a desired angle by engaging the locating pin on the shaft of the pool accessory device.

14. The device of claim 13 wherein said means for securing the shaft of the pool accessory device includes:

a threaded aperture in said shaft holding member in fluid communication with said shaft aperture; and a threaded member rotatably positioned in said threaded aperture and extending into said shaft aperture.

15. The device of claim 13 wherein said shaft holding member is removably attached to said c-shaped tube in a plurality of angular positions.

16. A device for securely mounting a swimming pool accessory device having a shaft, and a spring-pin extending outward from the shaft, said device comprising:

a c-shaped tube;

a shaft holding member attached to said c-shaped tube, said shaft holding member having a shaft aperture therethrough and wherein said shaft aperture is cylindrical and sized to correspond in geometry with and receive the shaft of the pool accessory device, and wherein said shaft holding member is a cylindrical tube; and means for securing the shaft of the pool accessory device in said net aperture, said means for securing the shaft of the pool accessory device including a plurality of through holes in said shaft holding member, and wherein said through holes are in fluid communication with said shaft aperture.

17. A device for securely mounting a swimming pool accessory device having a shaft and a spring-pin extending outward from the shaft, said device comprising:

a c-shaped tube;

a shaft holding member attached to said c-shaped tube, said shaft holding member having a shaft aperture therethrough and wherein said shaft aperture is cylindrical and sized to correspond in geometry with and receive the shaft of the pool accessory device and wherein said shaft holding member is a cylindrical tube; and means for securing the shaft of the pool accessory device in said net aperture wherein said means for securing the shaft of the pool accessory device is a plurality of slots situated about the periphery of one end of said cylindrical tube.

* * * * *